US006336846B1

(12) United States Patent
Park et al.

(10) Patent No.: US 6,336,846 B1
(45) Date of Patent: Jan. 8, 2002

(54) CHEMICAL-MECHANICAL POLISHING APPARATUS AND METHOD

(75) Inventors: Choul-gue Park; Keon-young Ko, both of Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/546,475

(22) Filed: Apr. 10, 2000

(30) Foreign Application Priority Data

Jul. 2, 1999 (KR) ..... 99-26550

(51) Int. Cl.[7] ..... B24B 1/00
(52) U.S. Cl. ..... 451/41; 451/288; 451/289
(58) Field of Search ..... 451/41, 285, 286, 451/287, 288, 6, 388, 398, 289

(56) References Cited

U.S. PATENT DOCUMENTS 5,931,725 A * 8/1999 Inaba et al. ..... 451/288
5,957,751 A * 9/1999 Govzman et al. ..... 451/8
6,110,012 A * 8/2000 Maury et al. ..... 451/36

* cited by examiner

*Primary Examiner*—Timothy V. Eley
*Assistant Examiner*—Dung Van Nguyen
(74) *Attorney, Agent, or Firm*—Volentine Francos, PLLC

(57) ABSTRACT

A chemical-mechanical polishing (CMP) apparatus has a polishing head onto which a semiconductor wafer is fixed for holding the surface of the semiconductor wafer in contact with the surface of a polishing pad. The polishing head includes a wafer carrier and a retainer ring which guides the edges of the semiconductor wafer. The retainer ring has an opening through which air is supplied to the lower portion thereof, such that air is injected between the semiconductor wafer and the polishing pad through the opening before separating the semiconductor wafer from the polishing pad after the polishing process. The injected air reduces the adsorptive force between the semiconductor wafer and the polishing pad. Therefore, the semiconductor wafer can be easily separated from the polishing pad when the polishing head is raised.

7 Claims, 3 Drawing Sheets

CHEMICAL-MECHANICAL POLISHING APPARATUS AND METHOD

BACKGROUND OF THE INVENTION

1. Field of the Invention

The present invention relates to an apparatus and method for fabricating semiconductor devices, and more particularly, to a chemical-mechanical polishing (CMP) apparatus and method.

2. Background of the Related Art

As the integration of semiconductor devices increases, multi-level interconnection technology has been put into practical use. Accordingly, local and global planarization of interlayer dielectric films has become important. Currently, a widely used CMP method of polishing the surface of a semiconductor wafer employs chemical components contained in a slurry solution, mechanical components of a polishing pad, and a polishing agent.

A CMP apparatus is mainly used in polishing the front face of a semiconductor wafer while fabricating semiconductor devices on the wafer. In general, in order to make the surface of the wafer as flat as possible, the wafer is planarized or softened at least one time during the fabrication process. In order to polish the wafer, the wafer is placed on a carrier, put into contact with the polishing pad covered with slurry and then pressed. While polishing is carried out, both the polishing pad and the wafer-loaded carrier rotate.

After polishing is carried out, the carrier moves upward so that the wafer is completely separated from the polishing pad. In this case, deionized water remains between the wafer and the surface of the polishing pad. Due to the deionized water, a strong adsorptive force is produced on the contact surface between the wafer and the polishing pad. If the carrier is raised in the presence of the adsorptive force, the wafer may separate from the carrier and remain fixed on the polishing pad. In such an event, subsequent processes would not be performed, and damage to the wafer may be caused.

SUMMARY OF THE INVENTION

To solve the above problems, it is an object of the present invention to provide a chemical-mechanical polishing (CMP) apparatus and method, by which a wafer stays on the carrier when the wafer-loaded carrier separates from the polishing pad after polishing is completed.

Accordingly, the present invention provides a CMP apparatus having a polishing pad covered with slurry, and a polishing head fixed on a semiconductor wafer for holding the surface of the semiconductor wafer in contact with the surface of the polishing pad, wherein the polishing head includes a wafer carrier on which the semiconductor wafer is fixed, and a retainer ring formed along the wafer carrier so as to guide the edges of the semiconductor wafer. The retainer ring has an opening through which air is supplied to the lower portion thereof, so that air is injected between the semiconductor wafer and the polishing pad through the opening before separating the semiconductor wafer from the polishing pad after the polishing process.

It is preferred that the opening is close to the semiconductor wafer and the opening is connected to an air injection opening formed in a shaft for supporting the polishing head and the rotary shaft of the polishing head. Also, the opening may vertically penetrate the inside of the retainer ring.

Also, the CMP apparatus may further include a sensor for sensing whether the semiconductor wafer is adhered to the wafer carrier after separating the wafer carrier from the polishing pad.

The present invention further provides a CMP method in which the polishing head moves upward so that the semiconductor wafer is separated from the polishing pad after polishing is complete, while the adsorptive force between the semiconductor wafer and the polishing pad is reduced by injecting air therebetween through the opening.

Here, the CMP method may further include sensing whether or not the semiconductor wafer is adhered to the polishing head after the polishing head is separated from the polishing pad, and displaying the sensing result to a user.

BRIEF DESCRIPTION OF THE ATTACHED DRAWINGS

The above objects and advantages of the present invention will become more apparent by describing in detail a preferred embodiment thereof with reference to the attached drawings in which.

DETAILED DESCRIPTION OF PREFERRED EMBODIMENT

A preferred embodiment of the present invention will be described below in detail with reference to the attached drawings. However, the present invention may be embodied in may different forms and should not be construed as limited to the embodiment set forth herein; rather, this embodiment is provided so that this disclosure will be thorough and complete and will fully convey the scope of the invention to those skilled in the art. Like numbers refer to like elements throughout.

Figure 1:
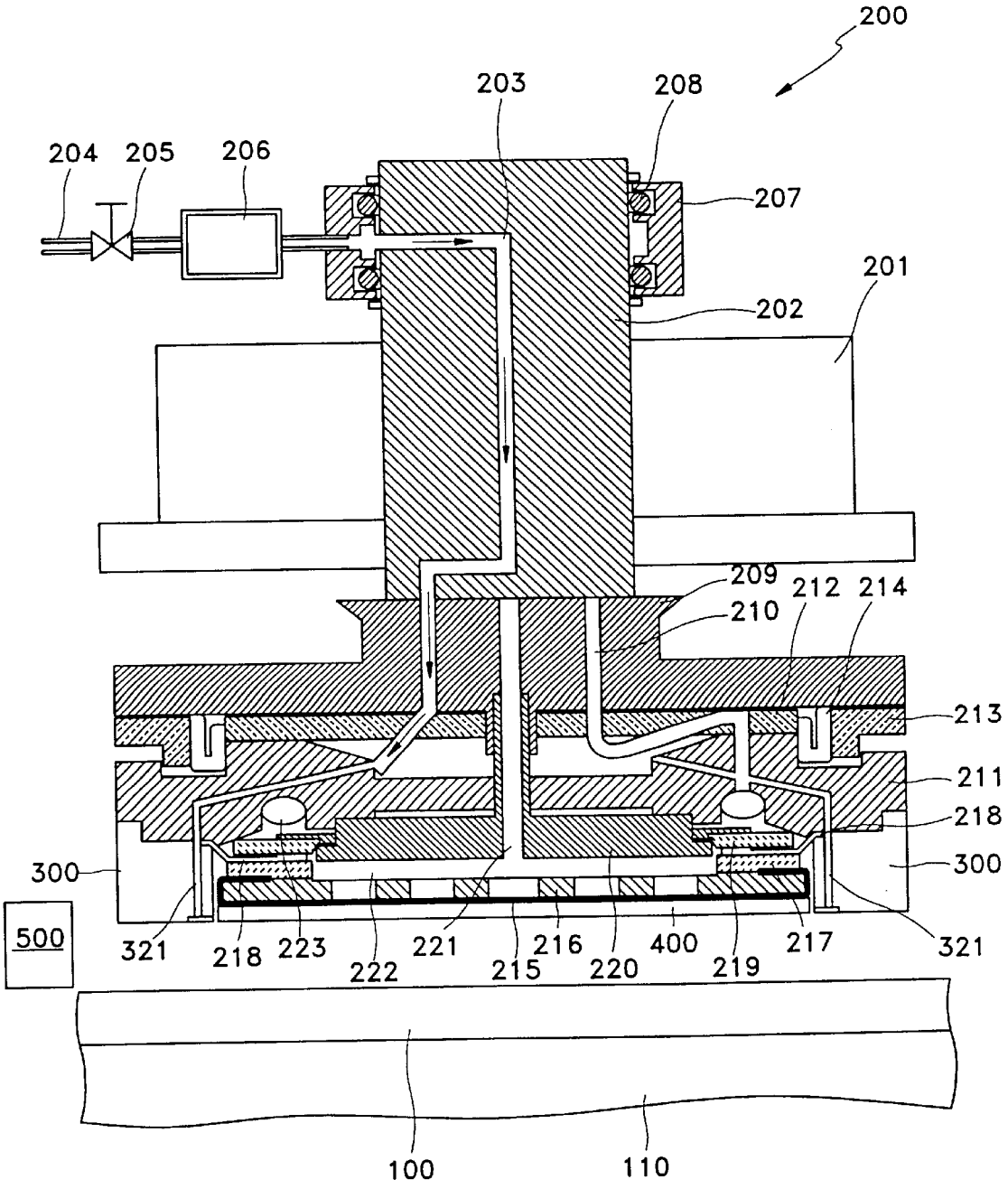
FIG. 1 is a cross-sectional view illustrating a polishing head of a CMP apparatus according to the present invention.

Referring to FIG. 1, the CMP apparatus includes a polishing pad 100 and a polishing head 200. The polishing pad 100 is mounted on a polishing platen 110 which rotates about a shaft and is driven by a driving motor (not shown). The polishing pad 100 rotates with the polishing platen 110. While the polishing process is carried out, a slurry comprising a chemical solution and polishing particles is supplied onto the surface of the polishing pad 100.

The polishing head 200 allows the surface of a semiconductor wafer 400 to contact the surface of the polishing pad 100 while the polishing process is carried out. During the polishing process, the polishing head 200 rotates about a rotary shaft. A motor 201 is fixed on a shaft 202 and the polishing head 200 rotates around the shaft 202 driven by the motor 201.

A plurality of air pressure lines 203 are inserted into the shaft 202. Air is supplied or exhausted through the air pressure lines 203. The shaft 202 is connected to an external air supply duct 204. In the air supply duct 204, a valve 205 controls the supply or exhaustion of air and a gauge 206 measures the amount of air supplied to or exhausted from the air supply duct 204. Since the shaft 202 rotates, the air supply duct 204 is not directly connected to the shaft 202 but is connected thereto through a rotary unit 207. The rotary unit 207 surrounds the shaft 202 and includes a rotary portion which rotates with the shaft 202 and a stationary portion which is fixed even when the shaft 202 rotates. An opening used as passage of air is formed between the stationary portion and the rotary portion. The external air supply duct 204 is inserted into the stationary portion so that the air supplied through the air supply duct 204 moves from the stationary portion to the rotary portion through the opening to then be supplied to the air pressure lines 203 in the shaft 202. The rotary portion of the rotary unit 207 is fixed with the side wall of the shaft 202 by O-rings 208.

The shaft 202 is connected to a manifold 209 made of steel. Connection lines 210 corresponding to the plurality of air pressure lines 203 in the shaft 202 are inserted into the manifold 209. The respective air pressure lines 203 in the shaft 202 are connected to the respective connection lines 210 in the manifold 209 one by one so that the air supplied through the respective air pressure lines 203 is transmitted through the corresponding connection lines 210. Since the manifold 209 is fixed on the shaft 202, it rotates as the shaft 202 rotates.

A wafer carrier 211 is disposed under the manifold 209 with first and second clamps 212 and 213 disposed therebetween. The first clamp 212 is fixed on the manifold 209 at its cental part, and the second clamp 213 is fixed on the manifold 209 at its edge. A rolling diaphragm 214 made of an elastic material is arranged in the space defined by the manifold 209, the wafer carrier 211, the first clamp 212 and the second clamp 213. The rolling diaphragm 214 downwardly moves various devices disposed thereunder or restores them into their original locations by its expansion or contraction due to air supply or exhaustion.

The wafer carrier 211 is covered with a thin elastic membrane 215 which contacts the semiconductor wafer 400, and a perforated plate 216, having a plurality of through holes, is disposed thereon. The perforated plate 216 is fixed by third clamps 217 disposed at its edges. A flexure 218 fixed on a fourth clamp 219 at its one end is disposed above each third clamp 217. The other end of the flexure 218 is fixed on the wafer carrier 211. A ceramic plate 220 is disposed above and spaced a predetermined distance apart from the perforated plate 216. A first pipe 221 is inserted into and penetrating the ceramic plate 220. One end of the first pipe 221 is inserted into the connection line 210 of the manifold 209 and is movable vertically.

There is provided a chamber 222 defined by the perforated plate 216, the third clamp 217 and the ceramic plate 220. The pressure in the chamber 222 can be adjusted by supplying or exhausting air passing through the first pipe 221 penetrating the ceramic plate 220. The portion of the wafer carrier 211 facing the fourth clamp 219 has a round groove, and an extensible/contractible cylindrical tube 223 is fixed in a hermetical space between the wafer carrier 211 and the fourth clamp 219 along the groove. The expansion/contraction due to supplying air into or exhausting air from the cylindrical tube 223 downwardly moves the devices disposed thereunder or restores them into their original locations.

A retainer ring 300 is fixed along the edges of the lower portion of the wafer carrier 211 in an annulate shape so as to guide the circumferential edges of the semiconductor wafer 400. During the polishing process, an appropriate pressure is applied to the polishing pad 100 to improve the polishing profile. An opening 321 through which air is supplied to the lower portion of the retainer ring 300 is formed to penetrate the inside of the retainer ring 300. The air is injected between the semiconductor wafer 400 and the polishing pad 100 through the opening 321 before the semiconductor wafer 400 is separated from the polishing pad 100 after the polishing process.

Figure 2A:
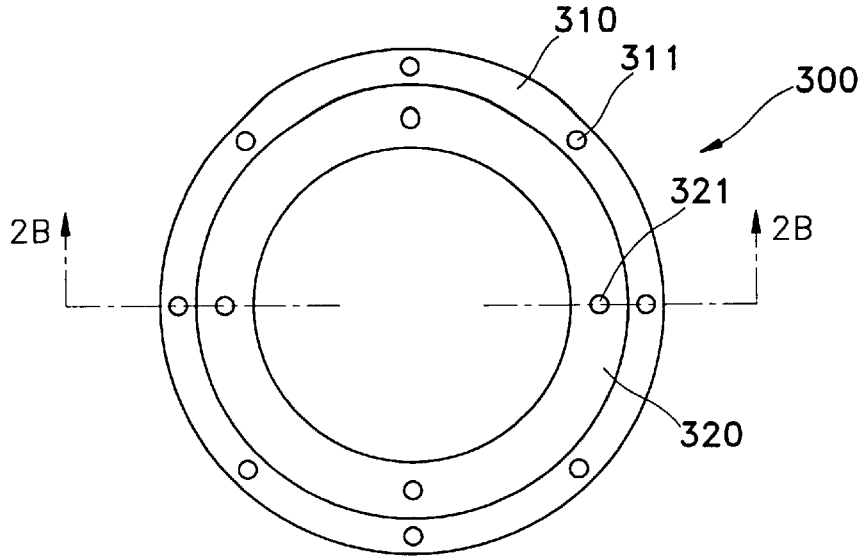
FIG. 2A is a top view of a retainer ring of the CMP apparatus of FIG. 1.
Figure 2B:
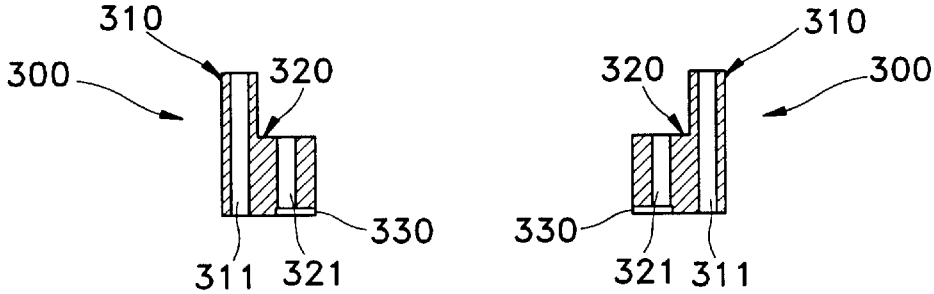
FIG. 2B is a cross-sectional view taken along the line 2B—2B in FIG. 2A.
Figure 3:
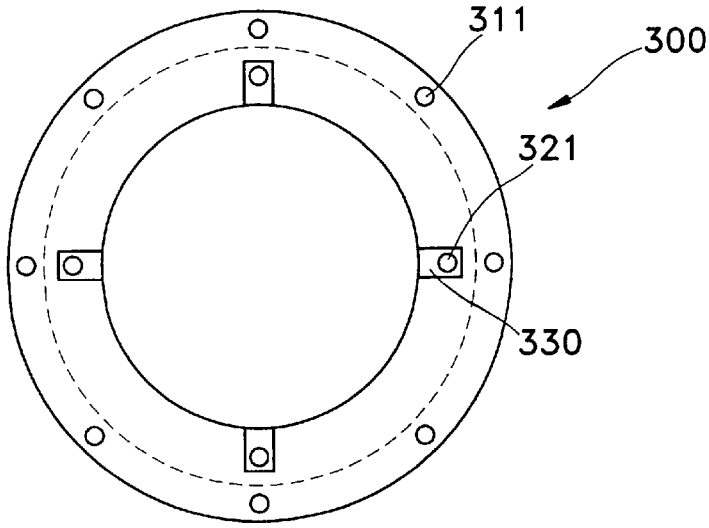
FIG. 3 is a bottom view of the retainer ring of FIG. 2A.

Referring to FIGS. 2A and 2B, when viewed from above, the retainer ring 300 is divided into two parts having different heights. A higher part 310 has a thread groove 311 into which a thread can be inserted, and a lower part 320 has an opening 321 through which air can pass. When viewed from below as in FIG. 3, a rectangular groove 330 is formed around the opening 321 of the retainer ring 300.

Referring back to FIG. 1, the opening 321 formed in the retainer ring 300 is for injecting air between the semiconductor wafer 400 and the polishing pad 100 before separating the semiconductor wafer 400 from the polishing pad 100 after the polishing process. To this end, the opening 321 is connected to an external air injection unit. For example, as shown in the drawing, the opening 321 penetrates the wafer carrier 211, the manifold 209 and the shaft 202, to then be connected to the air injection duct 204. As stated above, the air exhausted through the opening 321 is injected between the semiconductor wafer 400 and the polishing pad 100 before separating the semiconductor wafer 400 from the polishing pad 100 after the polishing process. Since the opening 321 is formed adjacent to the circumferential edge of the semiconductor wafer 400, most of the air exhausted through the opening 321 is injected between the semiconductor wafer 400 and the polishing pad 100. As described above, injecting air between the semiconductor wafer 400 and the polishing pad 100 weakens the adsorptive force produced between the semiconductor wafer 400 and the polishing pad 100, thereby easily separating the semiconductor wafer 400 from the polishing pad 100 when the wafer carrier 211 moves away from the polishing pad 100.

A sensor 500 for sensing whether or not the semiconductor wafer 400 has been separated from the polishing pad 100 after separating the semiconductor wafer 400 may be provided, preferably in close proximity to the wafer 400 and polishing pad 100. The sensor senses the state of the surface of the polishing pad 100 or the surface of the thin elastic membrane 215.

Figure 4:
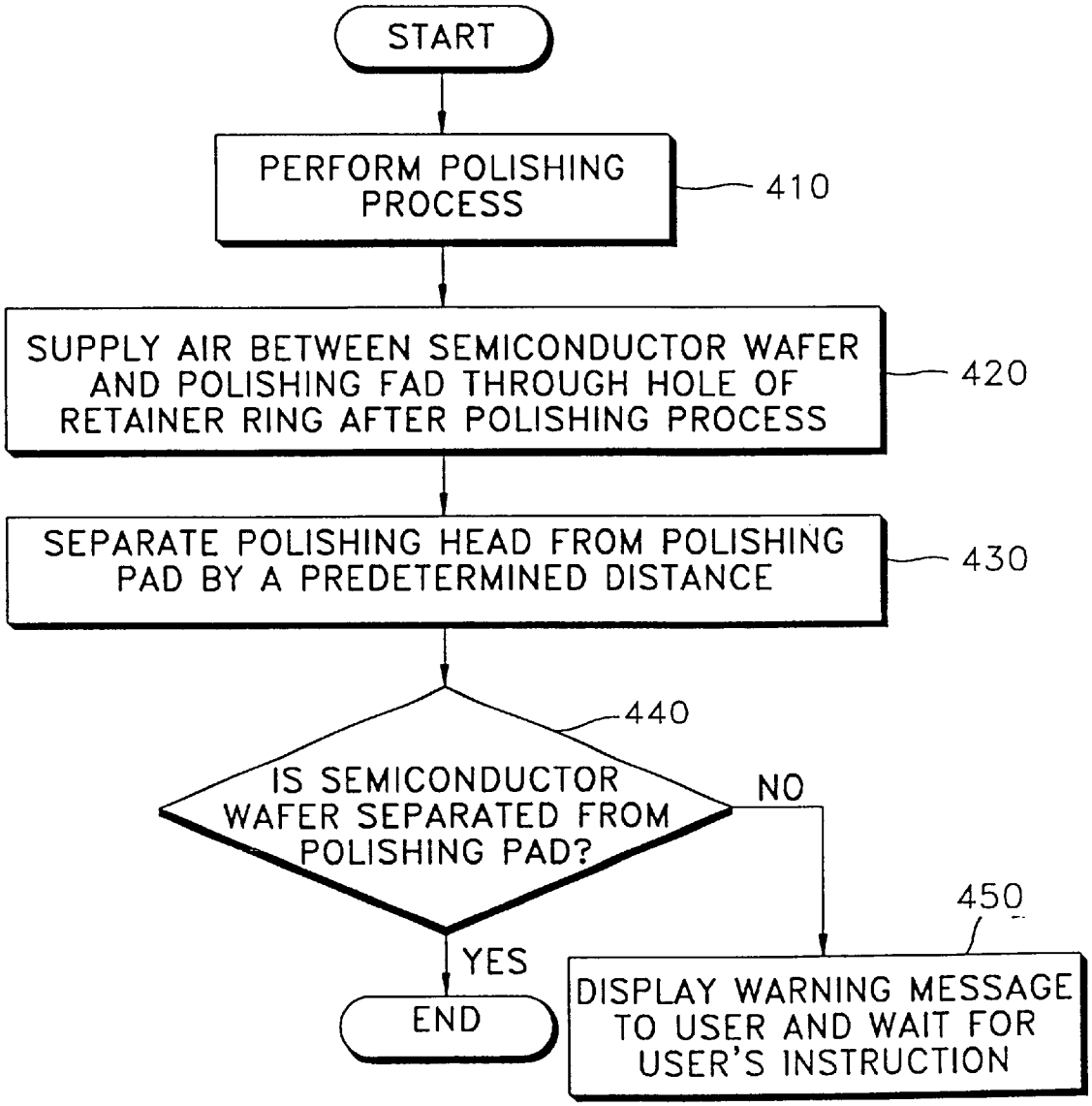
FIG. 4 is a flow chart illustrating a CMP method according to the present invention.

FIG. 4 is a flow chart illustrating a CMP method employing the above-described CMP apparatus. Referring to FIGS. 1 and 4, the CMP method according to the present invention will now be described.

First, in order to perform the polishing process, the semiconductor wafer 400 to be polished is seated on a wafer loader (not shown in FIGS. 1–3) positioned at a predetermined location. The wafer loader is disposed under the elastic membrane 215 of the polishing head 200 and spaced a predetermined distance therefrom. A robot (not shown in FIGS. 1–3) is typically used as means for carrying the semiconductor wafer 400 to the wafer loader. If the semiconductor wafer 400 is carried to the wafer loader, air is injected into the rolling diaphragm 214 of the polishing head 200, so that the rolling diaphragm 214 expands. Accordingly, the retainer ring 300 descends toward the wafer loader such that the retainer ring surrounds the semiconductor wafer 400 and the semiconductor wafer 400 contacts the elastic membrane 215.

Subsequently, in order to adsorb the semiconductor wafer 400 into the elastic membrane 215, a vacuum state is created in the chamber 222. Then, the elastic membrane 215 is adsorbed into the through hole of the perforated plate 216. Accordingly, the semiconductor wafer 400 is adsorbed into the portion of the adsorbed elastic membrane 215. In such a state, if the wafer loader is moved downwardly, the semiconductor wafer 400 is retained in a fixed position on the surface of the elastic membrane 215. Next, the rolling diaphragm 214 is contracted to raise the retainer ring 300.

Subsequently, the polishing head 200 on which the semiconductor wafer 400 is fixed is moved onto the polishing pad 100. While the retainer ring 300 is moved downwardly, the motor 201 is operated to rotate the polishing head 200. The polishing head 100 is also rotated by a motor connected to itself. At the almost same time as the rotation of the polishing head 200, the cylindrical tube 223 is dilated to press the semiconductor wafer 400 down into contact with the surface of the polishing pad 100. Then, the vacuum state of the chamber 222 is canceled to remove the adsorption state between the semiconductor wafer 400 and the elastic membrane 215 so that the semiconductor wafer 400 is made to contact the surface of the polishing pad 100 and the elastic membrane 215. In this state, slurry is supplied onto the surface of the polishing pad 100 to perform the polishing process (step 410).

After the polishing process is completed, air is exhausted through the opening 321 in the retainer ring 300 (step 420). The air exhausted through the opening 321 is supplied to the polishing pad 100. In particular, most of the air is supplied between the semiconductor wafer 400 and the polishing pad 100 so as to weaken the adsorptive force between the semiconductor wafer 400 and the polishing pad 100 which was created during the polishing process. Subsequently, a vacuum state is created in the chamber 222 so that the semiconductor wafer 300 is adsorbed into the elastic membrane 215. Here, since the adsorptive force between the semiconductor wafer 400 and the polishing pad 100 is considerably weakened, the semiconductor wafer 400 is easily adsorbed into the elastic membrane 215.

Then, the retainer ring 300 is raised until the semiconductor wafer 400 is spaced apart a predetermined distance from the surface of the polishing pad 100 (step 430). Next, the sensor is operated to sense the separation state of the semiconductor wafer 400 from the polishing pad 100 (step 440). If the semiconductor wafer 400 is separated from the polishing pad 100 and adhered to the elastic membrane 215, subsequent processing steps are performed. However, if the semiconductor wafer 400 is still adhered to the polishing pad 100 without being separated therefrom, a warning message is displayed to a user and the user's further instruction is awaited (step 450).

As described above, according to the present invention, a semiconductor wafer is successfully separated from a polishing pad in order to transfer the semiconductor wafer to another processing stage after the polishing process is completed, since the separation is made after the adsorptive force therebetween has been considerably reduced. Therefore, the semiconductor wafer can be easily separated from the polishing pad, together with a polishing head.

What is claimed is:

1. A CMP method comprising steps of:

fixing a semiconductor wafer on a wafer carrier having a retainer ring for guiding circumferential edges of the semiconductor wafer;

polishing the semiconductor wafer on a CMP apparatus having a polishing head and a polishing pad covered with slurry; and after the polishing process is completed, moving the polishing head upward so that the semiconductor wafer is separated from the polishing pad, while reducing the adsorptive force between the semiconductor wafer and the polishing pad by injecting air between the semiconductor wafer and the polishing pad through an opening in the retainer ring.

2. The CMP method according to claim 1, further comprising steps of:

sensing whether or not the semiconductor wafer is adhered to the polishing head after the polishing head is separated from the polishing pad; and displaying a sensing result to a user.

3. A chemical mechanical polishing (CMP) apparatus comprising:

a polishing pad having an upper surface onto which a slurry is to be supplied;

a polishing head disposed above said polishing pad, said polishing head including a wafer carrier for holding a wafer and pressing the wafer against the polishing pad, and an annular retainer ring mounted to the bottom of the wafer carrier for guiding the circumferential edge of a wafer as the wafer is being polished, said annular retainer ring having an air injection opening extending therethrough that is open to a lower surface of the ring adjacent the bottom of said wafer carrier; and an external air injection unit in direct open communication with said air injection opening of the annular retainer ring such that said external air injection unit supplies air into the air injection opening of said retainer ring wherein the air issuing from said air injection opening at said lower surface thereof can be injected between a wafer pressed against the polishing pad by the wafer carrier to thereby separate the wafer from the pad after the wafer has been polished.

4. The CMP apparatus according to claim 3, wherein said annular retainer ring has a groove in the bottom surface thereof that extends to the inner circumferential surface of the ring, said air injection opening of the retainer ring opening into said groove.

5. The CMP apparatus according to claim 3, wherein said wafer carrier defines an air chamber therein, and said wafer carrier comprises a perforated plate having an upper surface that delimits the air chamber such that perforations of the plate are in open communication with the air chamber, and an elastic membrane covering a bottom surface of the perforated plate at the bottom of the wafer carrier such that when air is exhausted from said air chamber the elastic membrane is drawn up against the bottom surface of the perforated plate to thereby cause a wafer to adhere thereto, said annular retainer ring extends around said elastic membrane, and said external air injection unit is also connected to said air chamber such that said external air injection unit exhausts air from said air chamber to cause a wafer to adhere to said elastic membrane whereby the wafer carrier can transfer a semiconductor wafer onto the polishing pad.

6. The CMP apparatus according to claim 5, and further comprising a rotary shaft to which said wafer carrier is fixed so as to rotate therewith, said rotary shaft having air lines extending therethrough, and said external air injection unit being connected to both said air chamber and to said air injection opening of the annular retainer ring via said air lines.

7. The CMP apparatus according to claim 6, and further comprising a manifold connecting said wafer carrier to said rotary shaft, said manifold having connection air lines extending therethrough, said connection lines connecting the air chamber and the air injection opening of said annular retainer ring to said air lines in the rotary shaft.

* * * * *